US010081480B2

(12) United States Patent
Niimi et al.

(10) Patent No.: US 10,081,480 B2
(45) Date of Patent: Sep. 25, 2018

(54) CONTAINER

(71) Applicant: MITSUBISHI GAS CHEMICAL COMPANY, INC., Tokyo (JP)

(72) Inventors: Kenichi Niimi, Tokyo (JP); Kiyonori Michiba, Tokyo (JP); Takashi Kubo, Tokyo (JP); Kazuyuki Minato, Akita (JP); Yoshiki Itou, Tokyo (JP); Takayoshi Itoh, Tokyo (JP); Jungo Taguchi, Tokyo (JP); Akihiro Masuda, Tokyo (JP); Tatsuo Iwai, Tokyo (JP)

(73) Assignee: MITSUBISHI GAS CHEMICAL COMPANY, INC., Tokyo (JP)

( * ) Notice: Subject to any disclaimer, the term of this patent is extended or adjusted under 35 U.S.C. 154(b) by 0 days.

(21) Appl. No.: 15/110,223

(22) PCT Filed: Mar. 12, 2015

(86) PCT No.: PCT/JP2015/057356
§ 371 (c)(1),
(2) Date: Jul. 7, 2016

(87) PCT Pub. No.: WO2015/141558
PCT Pub. Date: Sep. 24, 2015

(65) Prior Publication Data

US 2016/0325909 A1 Nov. 10, 2016

(30) Foreign Application Priority Data

Mar. 17, 2014 (JP) ..... 2014-054123

(51) Int. Cl.
*B65D 1/42* (2006.01)
*B65D 81/26* (2006.01)
(Continued)

(52) U.S. Cl.
CPC ..... *B65D 81/267* (2013.01); *A61J 1/03* (2013.01); *A61J 1/1418* (2015.05); *B65D 81/264* (2013.01)

(58) Field of Classification Search
CPC ..... B65D 81/267; B65D 81/264; A61J 1/03; A61J 1/1418
(Continued)

(56) References Cited

U.S. PATENT DOCUMENTS 7,185,780 B2 * 3/2007 Nomula ..... B65D 51/244 220/359.3
2013/0209350 A1 8/2013 Ishihara et al.

FOREIGN PATENT DOCUMENTS

EP 0 403 393 12/1990
EP 1544124 A 6/2005
(Continued)

OTHER PUBLICATIONS

Search Report issued in Japanese Patent Application No. PCT/JP2015/057356, dated Jun. 2, 2015.
(Continued)

*Primary Examiner* — Anthony Stashick
*Assistant Examiner* — James M Van Buskirk
(74) *Attorney, Agent, or Firm* — Greenblum & Bernstein, P.L.C.

(57) ABSTRACT

An oxygen-absorbing container includes a container body having a multilayer structure constituted by an innermost layer, an outermost layer and an intermediate layer therebetween, the container body having an opening part on an upper part thereof; and a sealing member bonded to an upper end surface of the opening part of the container body to seal an opening of the opening part. The innermost layer and the intermediate layer are bent outward at an upper end of the opening part and form a flat part and a surface of the flat part
(Continued)

forms the upper end surface of the opening part. When the sealing member is unsealed, part of the innermost layer on the upper end surface of the opening part is configured to be peeled off so as to leave an unsealed mark.

12 Claims, 9 Drawing Sheets

(51) Int. Cl.
*A61J 1/03* (2006.01)
*A61J 1/14* (2006.01)

(58) Field of Classification Search
USPC ..... 215/12.2, 42, 382; 220/657, 659, 66.22, 220/62.12, 62.11, 62.13, 656, 658; 206/204, 524.1–524.4, 524.6, 524.8
See application file for complete search history.

(56) References Cited

FOREIGN PATENT DOCUMENTS

| | | |
|---|---|---|
| JP | 11-48385 | 2/1999 |
| JP | 2002-193233 | 7/2002 |
| JP | 2004-106878 | 4/2004 |
| JP | 2007-181989 | 7/2007 |
| JP | 4622097 | 2/2011 |
| WO | 2012/105457 | 8/2012 |

OTHER PUBLICATIONS

International Preliminary Report on Patentability issued in PCT/JP2015/057356, dated Sep. 20, 2016.

* cited by examiner

CONTAINER

TECHNICAL FIELD

The present invention relates to an oxygen-absorbing container, a water-absorbing container, or a container having an oxygen-absorbing function and a water-absorbing function.

BACKGROUND ART

Some containers for accommodating pharmaceutical products, medical products, foods (such as supplements), cosmetic products, metallic products, electronic products, etc., have functions, depending on the application of the containers, such as an oxygen-absorbing property for absorbing oxygen inside the container and a water-absorbing property for absorbing water inside the container. This type of container typically has a multilayer structure having, in general, an innermost layer, an outermost layer, and an intermediate layer providing the above-mentioned functions between the innermost and outermost layers (Patent Document 1).

Such container is sealed by sealing an opening part on an upper part with a sealing member after the container is filled with content during production.

CITATION LIST

Patent Document

Patent Document 1: JP 4622097 B

SUMMARY

Technical Problem

In the above-mentioned container, a mark indicating that the sealing member has been unsealed, i.e., a so-called "unsealed mark," is preferably recognizable. The reason for this is that, if someone has unsealed the container, such fact should be recognized in order to secure the quality and safety of the content of the container.

However, providing the above-mentioned container with a function of leaving such unsealed mark has not been considered. In addition, it is not easy, in terms of cost, to provide containers with the function of leaving the unsealed mark.

The present invention has been made in light of the above circumstances and an object of the invention is to provide a container having a function of leaving an unsealed mark at low cost.

Solution to Problem

In order to achieve the above object, the present invention provides a container, comprising: a container body having a multilayer structure constituted by an innermost layer, an outermost layer and at least one intermediate layer therebetween, the container body having an opening part on an upper part thereof; and a sealing member bonded to an upper end surface of the opening part of the container body to seal an opening of the opening part, wherein: the innermost layer and at least a layer, which is adjacent to the innermost layer, in the intermediate layer are bent outward at an upper end of the opening part and form a flat part, and a surface of the flat part forms the upper end surface of the opening part; and when the sealing member is unsealed, part of the innermost layer on the upper end surface of the opening part is configured to be peeled off so as to leave an unsealed mark.

With the above configuration, the flat part constituted by the innermost layer and at least the layer adjacent to the innermost layer in the intermediate layer is formed at the upper end surface of the opening part and the innermost layer on the surface of such flat part is peeled off when the sealing member is stripped off. As a result, it is possible to provide the container with a function of leaving an unsealed mark at low cost In the above container, the intermediate layer may have an oxygen-absorbing layer and/or a water-absorbing layer. The innermost layer at the flat part may have a thickness of 200 μm or less.

The sealing member may be bonded in an annular shape to the surface of the flat part that constitutes the upper end surface of the opening part.

The innermost layer may have a smaller thickness than the outermost layer

The innermost layer may be made of a material having a lower strength than the outermost layer.

The innermost layer may contain low density polyethylene and/or linear short-chain branched polyethylene.

Distal end surfaces of the innermost layer and the intermediate layer in the flat part may be covered by the outermost layer.

The flat part may have a width that is 50% or more of a width of the upper end surface of the opening part.

At least one layer of the intermediate layer at the flat part may be colored. The innermost layer may be colored and have a color different from that of the colored layer in the intermediate layer.

A plurality of layers including a surface layer in the intermediate layer may be colored.

The sealing member may be transparent.

Advantageous Effects of Invention

The present invention can provide a container provided with a function of leaving an unsealed mark at low cost.

DESCRIPTION OF EMBODIMENTS

Figure 1:
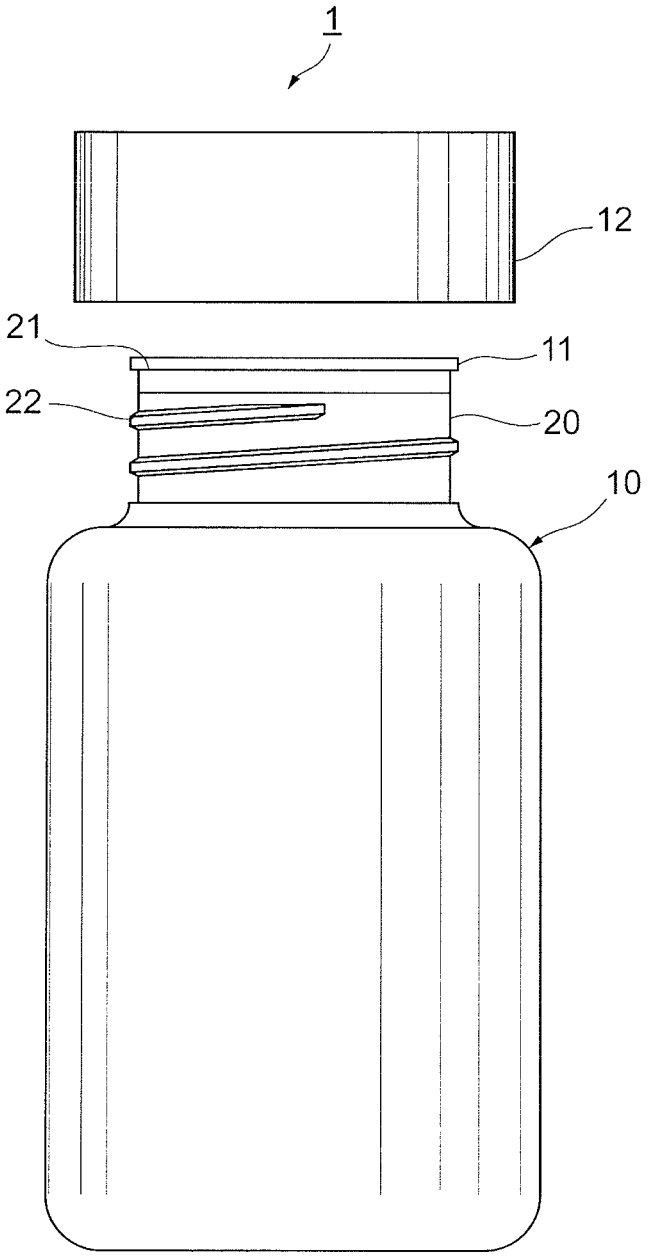
FIG. 1 is a perspective view schematically showing an oxygen-absorbing container.

Preferred embodiments of the present invention will now be described with reference to the attached drawings. It should be noted that the same element is denoted with the same reference symbol and redundant description thereof will be omitted. The positional relationship such as upper, lower, right and left is based on the positional relationship shown in the drawings, unless otherwise indicated. Furthermore, the dimensional ratios in the drawings are not limited to those shown in the drawings. The following embodiments are intended to be illustrative for explaining the present invention and the present invention is not limited to such embodiments.

FIG. 1 is a front view showing an outline of the configuration of an oxygen-absorbing container 1, being a container of the present embodiment. In the specification of the present application, a lid side of the oxygen-absorbing container 1 is defined as an upper side.

As shown in FIG. 1, the oxygen-absorbing container 1 includes, for example, a container body 10, a sealing member 11 and a lid 12.

Figure 2:
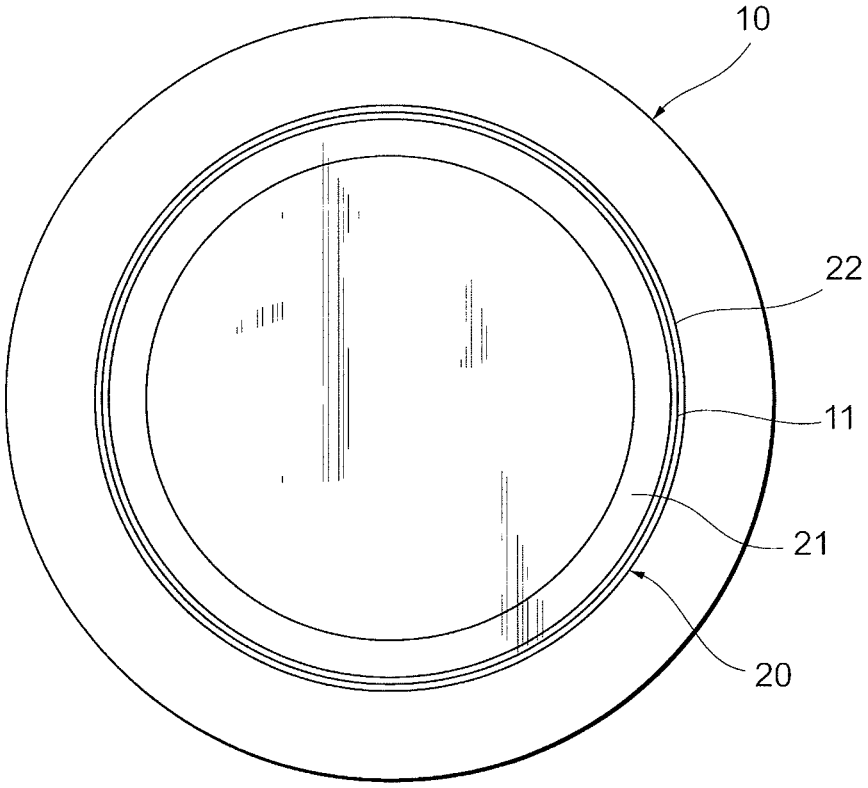
FIG. 2 is a top view showing a container body of the oxygen-absorbing container.

The container body 10 has a hollow, substantially cylindrical shape with a bottom, and an upper part of the container body 10 is provided with an opening part 20 having a smaller diameter than the other part. An upper end surface 21 of the opening part 20 is provided with an annular flat surface as shown in FIG. 2. An outer peripheral surface of the opening part 20 is provided with a threaded part (e.g., a male thread) 22.

The sealing member 11 is, for example, a circular transparent sheet made of a thermoplastic resin and the sealing member 11 is bonded to the upper end surface 21 of the opening part 20 of the container body 10 by thermal-compression bonding, thermal welding, or using an adhesive, etc.

The lid 12 is provided with a threaded part (e.g., a female thread) (not shown) on an inner peripheral surface, which can be engaged with the threaded part 22 on the opening part 20 of the container body 10.

Figure 3:
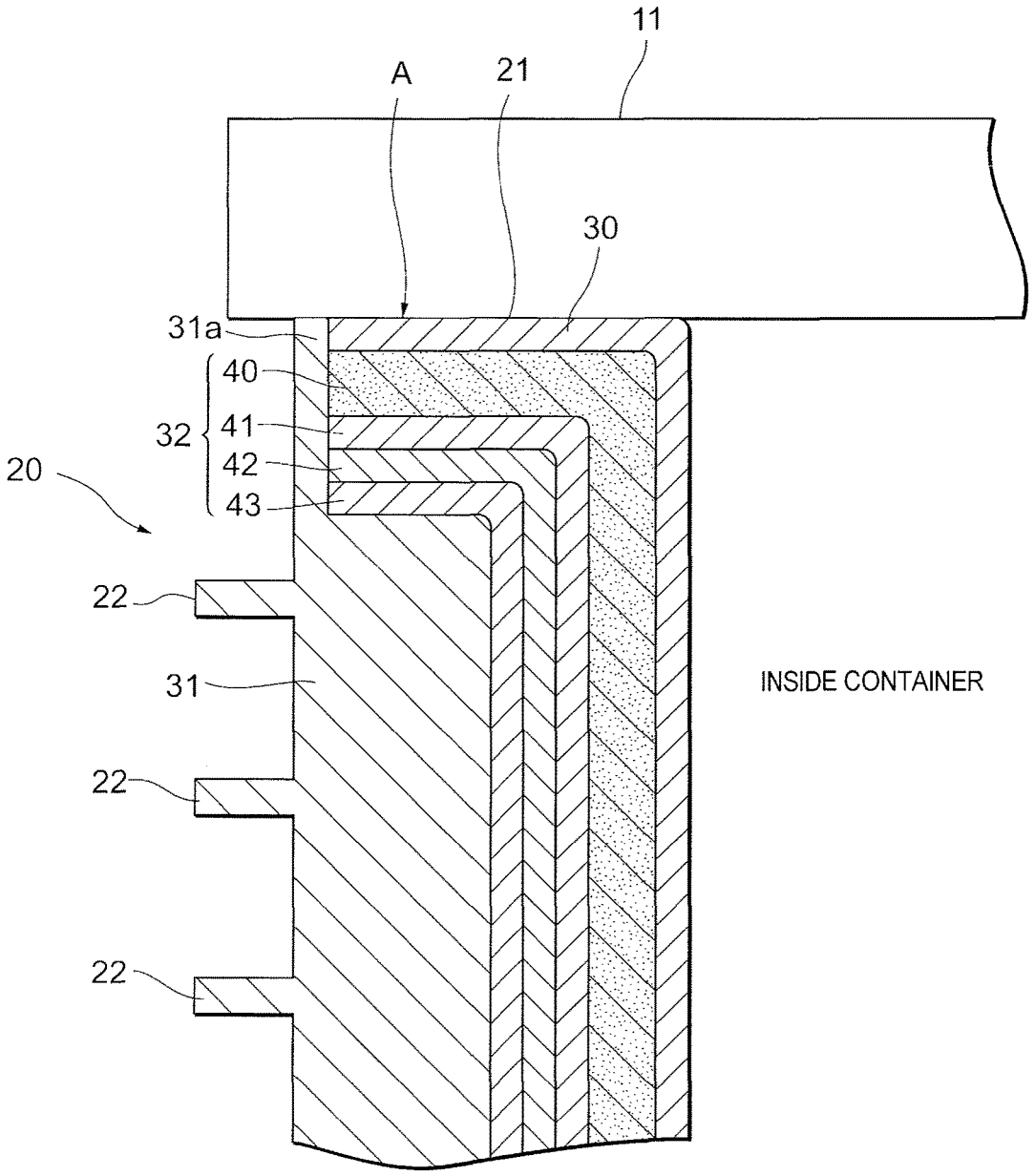
FIG. 3 is a cross-sectional view showing an example of a layer structure of an opening part in the oxygen-absorbing container.

The container body 10 has a multilayer structure. The opening part 20 of the container body 10 has an innermost layer 30, an outermost layer 31 and an intermediate layer 32 therebetween as shown in, for example, FIG. 3. The container body 10 is molded by so-called blow molding, in which a multilayer body having, for example, a tube-like shape (a multilayer parison) is molded by extrusion, the parison is clamped from both sides by a mold, and gas is blown into the multilayer body so as to expand the multilayer body.

The intermediate layer 32 is constituted by, for example, four layers having an oxygen-absorbing layer 40 (a functional layer), a bonding layer 41, a barrier layer 42 and a bonding layer 43, in the order mentioned, form the inner side toward the outer side.

The oxygen-absorbing layer 40 is made of, for example, LLDPE (linear low density polyethylene) and a material to be oxidized and has a function of absorbing oxygen. The oxygen-absorbing layer 40 may further contain a desiccant and other known additives.

The material to be oxidized (oxygen absorbent) is not particularly limited, as long as it is a composition having a function of removing oxygen from the air by oxidation reaction, adsorption, etc. Examples of the material to be oxidized may include: an oxygen absorbent, described in WO2012/105457, comprising metal which is obtained by subjecting, to acidic or alkaline aqueous solution, an alloy comprising (A) at least one transition metal selected from the group consisting of manganese, iron, platinum, and copper group metals and (B) at least one metal selected from the group consisting of aluminum, zinc, tin, lead, magnesium, and silicon to elute and remove at least part of the component (B); metal powder such as iron powder; a reductive inorganic substance such as an iron compound; polyhydric phenols; polyhydric alcohols; an unsaturated aliphatic acid compound; a reductive organic substance such as ascorbic acid or the salt thereof; a resin composition comprising a resin having a carbon-carbon unsaturated bond and/or oligomer and a transition metal catalyst; and an oxygen-absorbing composition comprising a metal complex, etc., as a base compound for an oxygen absorption reaction. Alternatively, the material to be oxidized may be an inorganic compound with an oxygen defect formed therein, which may be obtained by heating and reduction in an oxygen-free atmosphere or by ultraviolet irradiation, although the production process thereof is not particularly limited. Examples of such inorganic compound with an oxygen defect formed therein may include titanium dioxide, zinc oxide and cerium oxide, in which examples of the titanium oxide may include those having a crystalline system such as an anatase type, a rutile type and a brookite type, examples of the zinc oxide include a wurtzite type, examples of the cerium oxide include those having a crystalline system such as a lanthanum oxide type or a fluorite type. In particular, titanium dioxide having an anatase type is preferable as an oxygen absorbing material of the present invention. As the cerium oxide, a cerium oxide having a lattice defect such as, for example, the cerium oxide described in JP4001614 B, can be preferably used.

The oxygen-absorbing layer 40 is used as-is if it is colored due to its composition or is used after being colored using a pigment, etc. if it is colorless due to its composition. The color of the oxygen-absorbing layer 40 is preferably different from the color of the innermost layer 30.

By selecting a material to be oxidized whose color changes after oxidation as the material to be oxidized contained in the oxygen-absorbing layer 40, the container 1 can be provided with a function of allowing the oxidation of the material to be oxidized to be recognizable, i.e., the function of allowing the state wherein the container 1 has absorbed oxygen to be recognizable. As the material to be oxidized which changes color after oxidation, for example, if the oxygen absorbent described in WO2012/105457 comprises nickel as a main ingredient, the color of the oxygen absorbent is red before oxidation and changes to a bluish black color after oxidation. If the oxygen absorbent described in WO2012/105457 comprises iron as a main ingredient, the color of the oxygen absorbent changes from a bluish gray color to black due to oxidation. In an oxygen-absorbing composition comprising iron powder and a metallic halide, the color thereof changes from black to brown. In the case of cerium oxide, the color thereof is navy blue before oxidation and changes to light yellow after oxidation. If the container body 10 is sealed using a transparent sealing member 11, such as an alumina vapor-deposited film in the present invention, the state in which the container 1 has absorbed oxygen can be checked by observing the color of the material to be oxidized contained in the oxygen-absorbing layer 40, which facilitates quality assurance. Even if an opaque material such as an aluminum foil is used as the sealing member 11, it is still possible to check that the oxygen absorbent has worked by checking the color of the material to be oxidized which is exposed when the container is unsealed. Since a portion with which oxygen entering the container first contacts is an end surface of a sealed part of the opening part 20 of the container, such portion is most effective as a portion to be provided with such indicator function. The oxygen-absorbing layer 40 has a thickness of from 1 μm to 600 μm, preferably about from 5 μm to 200 μm, and more preferably from 10 μm to 150 μm.

The bonding layer 41 and the bonding layer 43 are made of an adhesive resin and bond the barrier layer 42 to the other layers. The barrier layer 42 is made of an oxygen impermeable barrier resin such as EVOH (ethylene vinyl alcohol copolymer resin) and has a function of blocking oxygen. The bonding layers 41, 43 have a thickness of about from 1 μm to 100 μm and preferably from 5 μm to 50 μm. The barrier layer 42 has a thickness of about from 1 μm to 100 μm and preferably from 5 μm to 50 μm.

The innermost layer 30 is made of, for example, low density polyethylene (LDPE) and/or linear short-chain branched polyethylene and colored white by a white pigment being added thereto. The outermost layer 31 is made of, for example, HDPE (high density polyethylene). As such, the innermost layer 30 is made of a material having a lower strength (mechanical strength) than the outermost layer 31. The materials of these layers 30, 31 are not limited to those described above, and they may be selected arbitrarily. Although the innermost layer 30 may be colorless (transparent), it is preferable for the color thereof to be different from the color of the oxygen-absorbing layer 40.

The innermost layer 30 has a thickness of 200 μm or less, preferably 100 μm or less, and more preferably 50 μm or less. The outermost layer 31 has a thickness of about from 500 μm to 10,000 μm and preferably from 1,000 μm to 5,000 μm. Accordingly, the innermost layer 30 is formed to be relatively thin with a thickness of about 40% to 0.5% of the outermost layer 31 (excluding an upper end 31*a*).

The innermost layer 30 and, for example, all layers in the intermediate layer 32 are bent outward at the upper end of the opening part 20 and form a flat part A. An upper surface of the flat part A, i.e., the surface of the innermost layer 30, forms an upper end surface 21 of the opening part 20. The flat part A may have a width of 50% or more, preferably 70% or more, and more preferably 90% or more of the width of the upper end surface 21 of the opening part 20. The flat part A may have a width of from 0.5 mm to 10 mm.

An outer distal end surface of the flat part A, i.e., distal end surfaces of the innermost layer 30 and the intermediate layer 32 are covered by the upper end 31*a* of the outermost layer 31. The upper end 31*a* of the outermost layer 31 covering the distal end of the flat part A has a thickness of about from 1 μm to 100 μm. The flat part A can be formed by, in a state in which fins (i.e., portions that extend out of a mold of the container) of the innermost layer 30 and the intermediate layer 32 which are projected upward from the vicinity of an entrance of the opening part 20 during the above-mentioned blow molding of the container body 10 are extended outward, cutting the fins of the innermost layer 30 and the intermediate layer 32 while pressing the fins from the upper side of the opening part 20 toward the bottom side using a press-cutting die. At this time, the upper end 31*a* of the outermost layer 31 remains on the outer side of the distal ends of the innermost layer 30 and the intermediate layer 32 and the upper end 31*a* of the outermost layer 31 covers the distal end surfaces of the innermost layer 30 and the intermediate layer 32.

Figure 4:
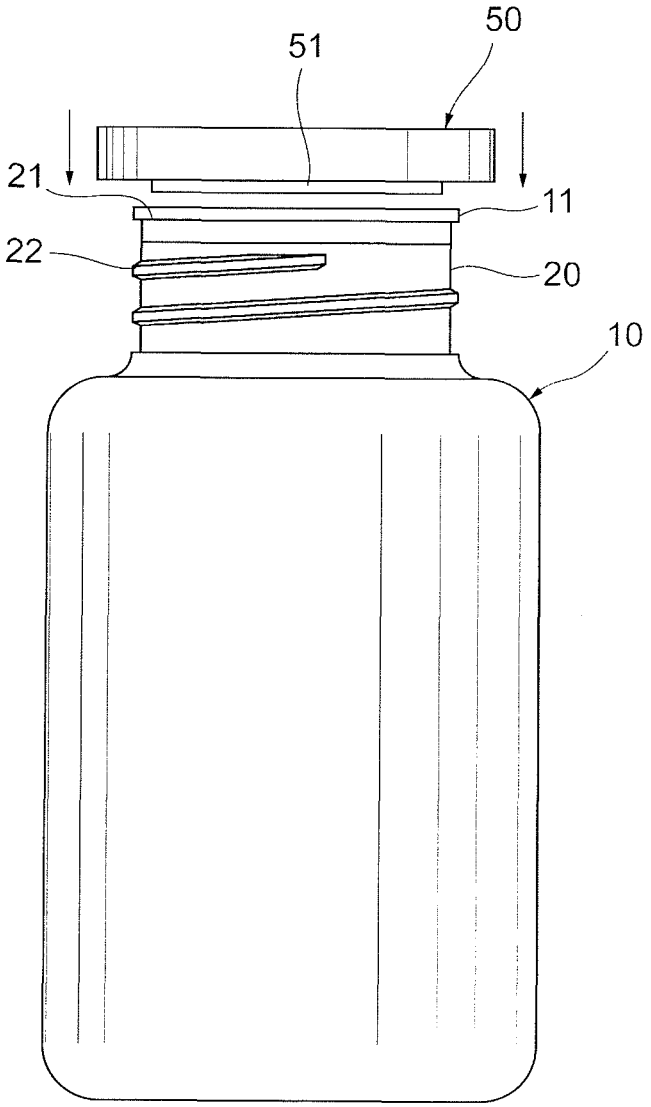
FIG. 4 is an illustration showing how the container body is sealed with a sealing member using a sealing board.
Figure 5:
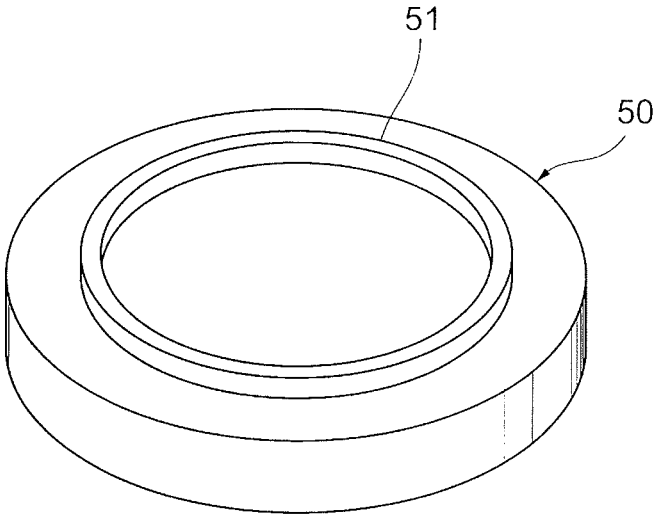
FIG. 5 is an illustration showing a projection in the sealing board.

When the oxygen-absorbing container 1 having the configurations as described above is manufactured, the content, such as a pharmaceutical product, is first introduced into the container body 10 from an opening of the opening part 20. Then, the sealing member 11 is bonded to the upper end surface 21 of the opening part 20. This bonding is performed by, for example, placing the sealing member 11 on the upper end surface 21 of the opening part 20 as shown in FIG. 4, and pressing a hot sealing board 50 on to the sealing member 11 to perform thermal welding. The sealing board 50 has an annular projection 51 on its lower surface as shown in, for example, FIG. 5 and the hot projection 50 is pressed onto the sealing member 11 and the pressed and heated portion in the sealing member 11 is thermally welded onto the innermost layer 30 on the upper end surface 21 of the opening part 20. In this way, the sealing member 11 is annularly bonded onto the surface of the flat part A so as to cover the opening part and the container is sealed. The oxygen inside the container is then absorbed by the oxygen-absorbing layer 40 of the container body 10 and the oxygen inside the container is removed. The lid 12 is attached to the opening part 20 after the sealing. It should be noted that the configuration of the sealing board 50 is not limited to the configuration described above. In addition, as an example sealing method, an induction sealing method can preferably be used when aluminum foil or the like is used for the sealing member.

Figure 6:
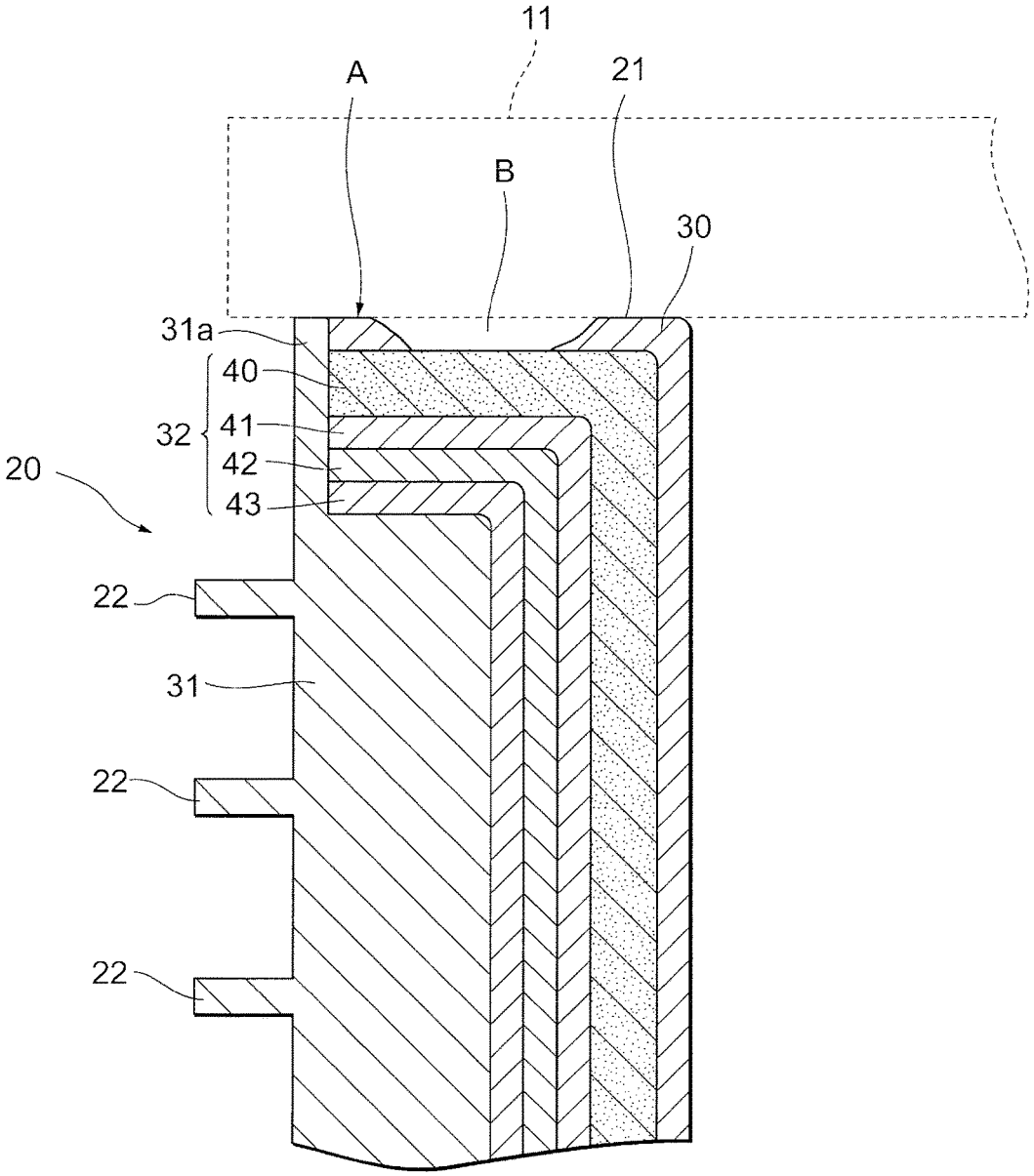
FIG. 6 is a cross-sectional view showing the opening part in a state in which an unsealed mark is formed on an upper end surface of the opening part.

According to the present embodiment, the innermost layer 30 and the intermediate layer 32 of the container body 10 are bent outward at the upper end of the opening part 20 and form the flat part A, and a surface of the flat part A constitutes the upper end surface 21 of the opening part 20. With such configuration, if someone strips off the sealing member 11, part of the innermost layer 30 on the upper end surface 21 of the opening part 20 is peeled off and broken, as shown in, for example, FIG. 6, and part of the oxygen-absorbing layer 40 underneath the peeled part is exposed or can be seen through the peeled part. This serves as a so-called unsealed mark B. Accordingly, it is possible to provide the container 1 with a function of leaving the unsealed mark B and to secure a tamper evidence function. Furthermore, since the innermost layer 30 and the intermediate layer 32 are bent outward and form the flat part A and the unsealed mark is formed in the flat part A, the function of leaving the unsealed mark can be provided in a simple manner at low cost. In addition, by bending the innermost layer 30 and the intermediate layer 32 to form the flat part A, a sufficient width can be secured for the unsealed mark, which allows the unsealed mark to be easily and reliably recognized.

In the present embodiment, since the thickness of the innermost layer 30 in the flat part A is 200 μm or less, when the sealing member 11 is peeled, the innermost layer 30 is easily peeled and the oxygen-absorbing layer 40 is easily exposed or can be seen through the peeled part. Thus, the fact that someone has unsealed the sealing member 11 can be more securely and easily recognized. In addition, since the innermost layer 30 is thin, the oxygen inside the container easily permeates the oxygen-absorbing layer 40 and the rate of oxygen absorption is significantly rapid. Accordingly, in a situation in which a medical product or a supplement is accommodated in the container, such content can be prevented from being degraded.

Since the innermost layer 30 is thinner than the outermost layer 31, the innermost layer 30 is more easily pealed due to the sealing member 11 and the fact that the sealing member 11 has been unsealed can be easily recognized.

Since the innermost layer 30 is made of a material having a lower strength than the outermost layer 31, the innermost layer 30 can be more easily peeled due to the sealing member 11 and the fact that the sealing member 11 has been unsealed can be easily recognized.

Further, since the innermost layer 30 is made of a low density polyethylene and/or a linear short-chain branched polyethylene, which is different from the outermost layer 31, the innermost layer 30 has a low mechanical strength and can therefore be easily peeled due to the sealing member 11. Accordingly, the unsealed mark can be left in a secure manner.

Since the distal end surfaces of the innermost layer 30 and the intermediate layer 32 are covered by the outermost layer 31, the appearance of the container 1 is preferable. In addition, since the intermediate layer 32 is not exposed, a chemical substance in the container can be prevented from unintentionally contaminating a medical product or a supplement due to direct contact between the intermediate layer and the medical product or supplement. When the sealing member 11 is stripped off and part of the innermost layer 30 is peeled off, the upper end surface of the annular outermost layer 31 is clearly left on the outermost circumference of the upper surface of the opening part 20. With such configuration, the unsealed mark which is an irregularly peeled part becomes more visible and the tamper evidence function can be secured.

Since the flat part A has a width of 50% or more of the width of the upper end surface 21 of the opening part 20, the width of the flat part A is sufficiently secured and the unsealed mark which is left after the peeling of the innermost layer 30 can be visually observed in a clearer and more secure manner.

Figure 7:
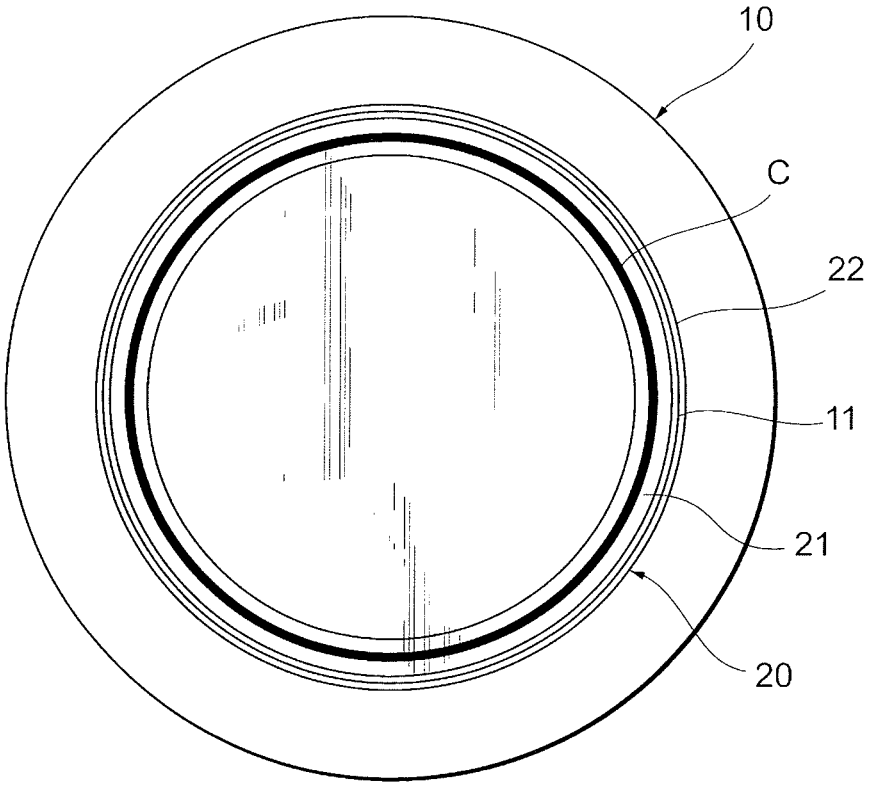
FIG. 7 is an illustration showing a ring in a bonded part which is formed when the sealing member has been appropriately sealed.

In the present embodiment, the innermost layer 30 in the flat part A is thin and the sealing member 11 is transparent and is annularly bonded to the surface of the flat part A constituting the upper end surface 21 of the opening part 20. In this case, it is easy to check whether or not the sealing member is appropriately bonded to the flat part A and provides sealing. Specifically, since the innermost layer 30 is thin, if the sealing member 11 is appropriately bonded to the flat part A, the colored oxygen-absorbing layer 40 underneath the bonded part C can be seen through the innermost layer 30 and the sealing member 11 as shown in FIG. 7. On the other hand, if the sealing member 11 is not appropriately bonded to the flat part A with dust or the like being introduced therebetween, the oxygen-absorbing layer 40 is seen with part of its ring-like shape missing. Accordingly, the appropriateness of the sealing provided by the sealing member 11 can be easily checked.

Since the oxygen-absorbing layer 40 of the intermediate layer 32 in the flat part A is colored, if someone has stripped off the sealing member 11 and part of the innermost layer 31 on the upper end surface 21 of the opening part 20 is peeled off and broken, part of the colored oxygen-absorbing layer 40 underneath the peeled part is exposed or can be seen through the peeled part. Accordingly, the unsealed mark becomes easily visible and recognizable. In addition, if the innermost layer 30 is colored and its color is different from the color of the oxygen-absorbing layer 40, the unsealed mark becomes even more visible and the unsealed mark can be visually observed in a clearer and more secure manner.

Although the preferred embodiments of the present invention have been described above with reference to the attached drawings, the present invention is not limited to those examples. It is obvious that a person skilled in the art could conceive of various changes or modifications within the scope of the ideas described in the scope of the claims and such changes and modifications should obviously be understood as belonging to the technical scope of the present invention.

For example, the configuration of the container body 10 of the oxygen-absorbing container 1 is not limited to the configuration in the embodiment above. For example, the types and functions of the intermediate layer 32, the number of layers and the thickness of the layers of the container body 10 may be different. For example, some of the bonding layers 41, 43 and the barrier layer 42, other than the oxygen-absorbing layer 40, in the intermediate layer 32 may be colored. In such case, the color is preferably a vivid color such as black. More than one layer in the intermediate layer 32 may be colored. In such case, if the oxygen-absorbing layer 40, being the outermost layer in the intermediate layer 32, is peeled off due to the sealing member 11, the colored layer underneath the peeled part is exposed and the unsealed mark can be clearly left. The barrier layer 42 may not be provided. The sealing member 11 may be opaque and may be made of a material having excellent barrier property against oxygen and water, such as aluminum.

Figure 8:
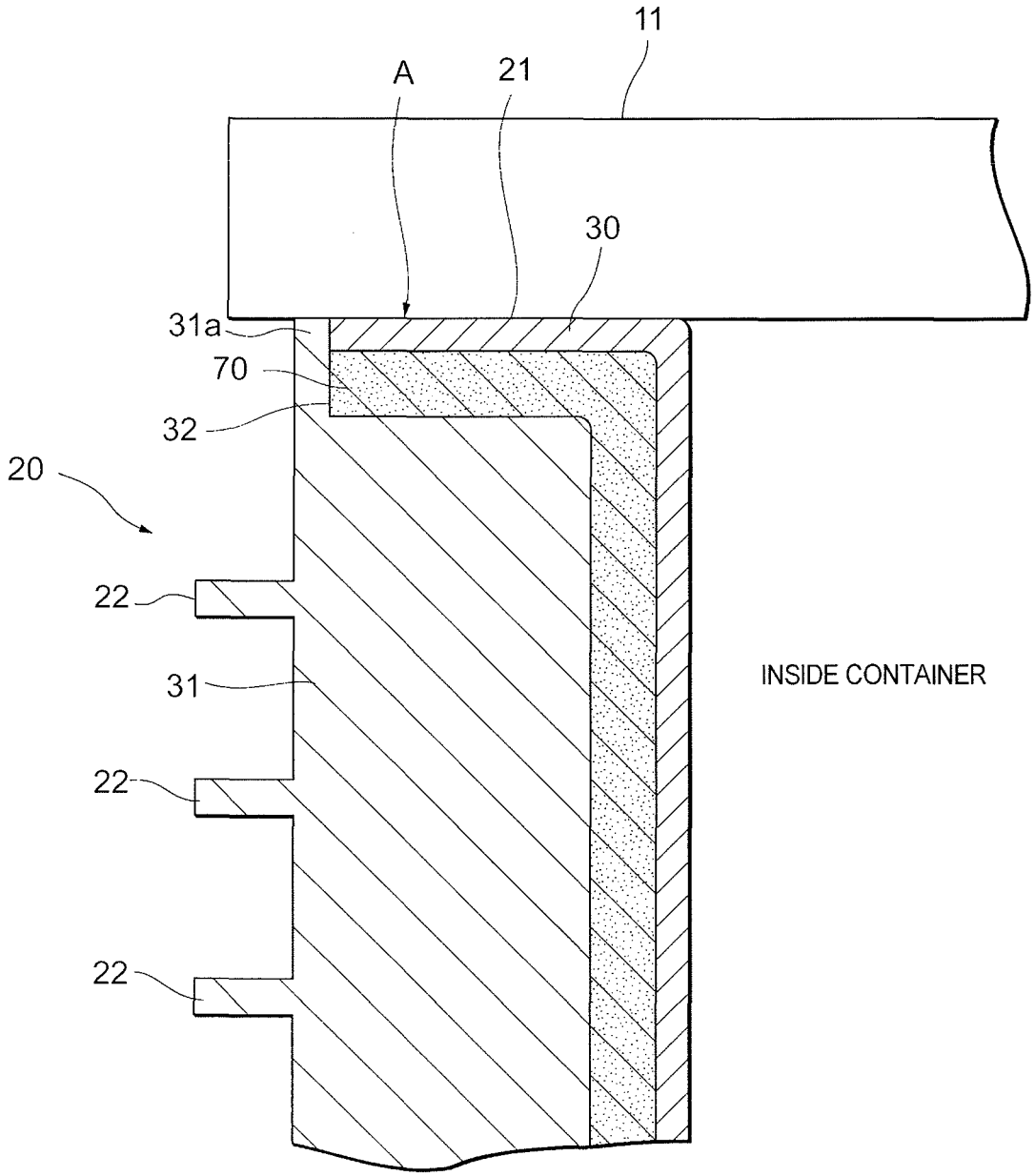
FIG. 8 is a cross-sectional view showing an example of a layer structure of an opening part of a water-absorbing container.

The container 1 may be a water-absorbing container having a water-absorbing layer. In such case, the intermediate layer 32 may be constituted by one layer as shown in, for example, FIG. 8 and may include a water-absorbing layer 70 serving as a functional layer. In this case, for example, the innermost layer 30 may be made of LLDPE or HDPE and may have a thickness of 200 μm or less, preferably from 1 μm to 100 μm, and more preferably from 5 μm to 50 μm. When LLDPE is used, for example, a white pigment may be added. The water-absorbing layer 70 may be made of, for example, PE, and a colored desiccant and may also contain a pigment. Such water-absorbing layer 70 may have a thickness of from 10 μm to 600 μm and preferably about from 50 μm to 400 μm and the outermost layer may have a thickness of 500 μm or more, preferably about 2,000 μm. The thicknesses should be designed in accordance with the volume of a product to be accommodated. The multilayer structure of the container body of the water-absorbing container is not limited thereto and may be selected in an arbitrary manner.

The present invention is also applicable to a container having both an oxygen-absorbing layer and a water-absorbing layer in the intermediate layer 32. For reference, the configurations of the above container are also applicable to an oxygen-impermeable container having an oxygen-impermeable layer in the intermediate layer.

Figure 9:
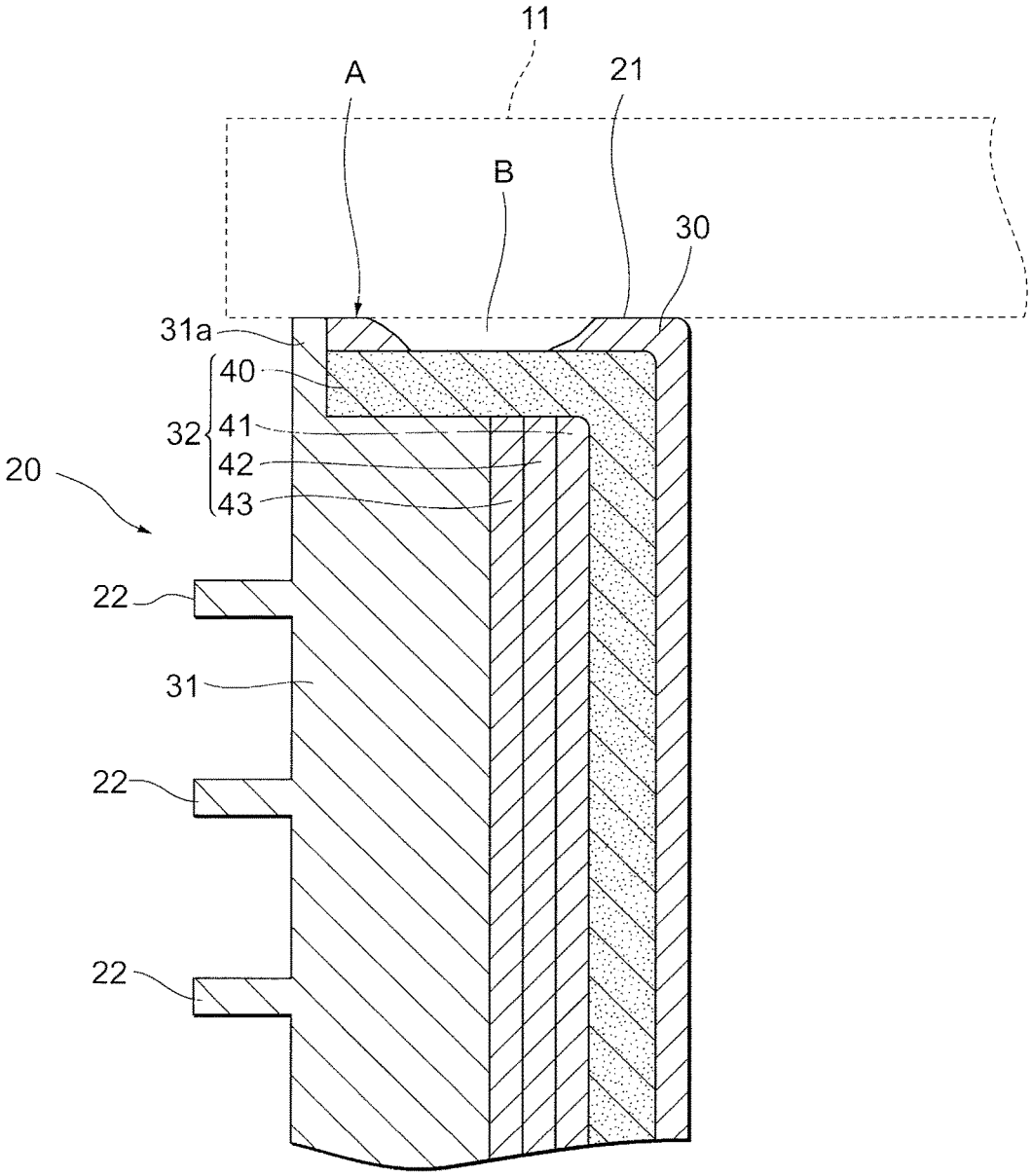
FIG. 9 is a cross-sectional view showing a state in which an unsealed mark is formed when only a layer, which is adjacent to the innermost layer, in an intermediate layer is bent.

Although all the layers in the intermediate layer 32 are bent in the above embodiment, it is only necessary for at least a layer adjacent to the innermost layer 30 to be bent and the other layers may not be bent. For example, as shown in FIG. 9, only the innermost layer 30 and the oxygen-absorbing layer 40 in the intermediate layer 32 may be bent and the other bonding layer 41, barrier layer 42 and bonding layer 43 may not be bent. In such case as well, the innermost layer 30 is peeled off when the sealing member 11 is stripped off and part of the oxygen-absorbing layer 40 is exposed, allowing the unsealed mark to be left.

Application of Container

In containers according to the present invention, an oxygen-absorbing container which employs the oxygen absorbent described in WO2012/105457 as the material to be oxidized can accommodate a low-water content product which is preferably stored at 0 to 30% RH and a product containing no water, and can absorb oxygen. Examples of the low-water content product include: foods such as powdered soup, powdered beverages, powdered confectionery, condiments, grain powder, nutritional foods, health foods, food colorings, flavors and spices; as well as drugs such as medicinal powder, washing power, dental powder and industrial chemicals, and examples of the shape of such products may include powder, granules, and tablets molded from such powder and granules. Examples of the products containing no water may include industrial components and pharmaceutical products such as atorvastatin and levothyroxine.

In the containers according to the present invention, an oxygen-absorbing container which employs metal powder such as iron powder or a reductive inorganic substance, such as an iron compound, as the material to be oxidized can accommodate a middle-water content product which is preferably stored at 30 to 50% RH and a high-water content product such as drinking water. Such container can accommodate various types of articles including high-water content foods represented by: confectionary such as jelly with pulp, sweet jellied bean paste and pudding; fruit such as pineapples, oranges, peaches, apricots, pears and apples; condiments such as liquefied soup stock, mayonnaise, soy bean paste and grated spice; pasty foods such as jam, cream and chocolate paste; liquid foods represented by liquid processed foods such as curry, liquid soup, simmered foods, pickles and stew; raw and cooked noodles such as buckwheat noodles, wheat noodles and ramen noodles; uncooked rice such as milled rice, moisture-conditioned rice and non-washing rice; processed rice products such as boiled rice, boiled rice with fish, meat and vegetables, festive red rice and rice gruel; and powder condiments such as powdered soup and powdered soup stock, as well as solid or solution type chemicals such as agricultural chemicals and pesticides; pharmaceutical products in a liquid, paste, solid, powder, pellet or tablet form; and articles such as cosmetic lotion, cosmetic cream, cosmetic emulsion, hair dye, hair dressing, shampoo, soap and detergent. Since such container can prevent oxygen from entering from the outside the container and allows the oxygen inside the container to be absorbed by a deoxidizer composition, it is possible to prevent oxidation degradation of the articles inside and to maintain a good quality for a long period of time.

EXAMPLES

The present invention will now be described by way of Examples. However, the present invention is not limited to such Examples. Examples according to the present invention will be described below.

Example 1

(Preparation of Metallic Powder 1)

An Al—Fe alloy was obtained by mixing Al (aluminum) powder and Fe (iron) powder at a ratio of 50 mass % each and melting them in nitrogen. The resulting Al—Fe alloy was crushed using a jaw crusher, a roll crusher and a ball mill, the crushed product was sieved using a 200-mesh screen (0.075 mm), and Al—Fe alloy having a size of 200-mesh or less was obtained. 150 grams of the resulting Al—Fe alloy powder was added to a 30 mass %-aqueous solution of sodium hydroxide and stirred and mixed at 50° for 1 hour. Then the mixed solution was left at rest and an upper-layer fluid was removed therefrom. The remaining precipitate was washed with distilled water until its pH became 10 or less and metallic powder 1, being an Al—Fe porous metallic powder, was obtained. The metallic powder 1 was stored in an aqueous solution in order to avoid contact with oxygen.

The resulting porous metallic powder was subjected to vacuum drying under the condition of 200 Pa or lower and 80° C. until its water content became 1 mass % or less to obtain dried Al—Fe porous metallic powder (hereinafter this dried Al—Fe porous metallic powder will be referred to as "the metallic powder 1"). The bulk density of the resulting metallic powder 1 was 1.3 g/cm$^3$ (measured in compliance with JIS Z 2504) and the iron content was 97.3 wt %. One gram of such metallic powder 1 was placed in an air-permeable small bag, which was further placed in a gas-barrier bag (an Al foil-laminated plastic bag) with a desiccant, and the gas barrier bag was filled with 500 mL of air (oxygen concentration of 20.9 vol %) and sealed. In such state, the metallic powder 1 was stored at 25° C. for 7 days. The specific surface area of the metallic powder 1 was measured using an automatic specific surface area measuring apparatus ("Gemini VII2390" manufactured by Shimadzu Corporation) and the specific surface area of the metallic powder 1 was 101.0 m$^2$/g.

(Preparation of Oxygen-Absorbing Resin Pellet 1)

The metallic powder 1 and linear low density polyethylene (NF384A (density 0.926) manufactured by Japan Polyethylene Corporation; hereinafter referred to as "LLDPE" in some contexts) were melted and kneaded at a ratio of the metallic powder 1:LLDPE=30:70 (mass ratio), extruded into a strand shape using a twin screw extruder having two types of feeders—a main feeder and a side feeder—which were subjected to nitrogen gas replacement and cut by a pelletizer to thereby obtain an oxygen-absorbing resin pellet 1. The LLDPE was introduced into the main feeder and the metallic powder 1 was added to the melted LLDPE through the side feeder. The density of the oxygen-absorbing resin pellet 1 was 1.2 g/cm$^3$.

(Preparation of Oxygen-Absorbing Hollow Container 1)

An oxygen-absorbing hollow container 1 having a capacity of 120 mL and a six-layer structure of, from the inner side toward the outer side of the container, innermost layer (30)/intermediate layer (oxygen-absorbing layer/adhesive layer/gas barrier layer/adhesive resin layer) (32)/outermost layer (31) was prepared using a 5-type, 6-layer direct blow molding machine at a molding temperature of 180° C. LLDPE was used for the innermost layer (30), and the oxygen-absorbing resin pellet 1, ethylene-vinyl alcohol copolymer resin (product name "EVAL F101 B" manufactured by KURARAY CO., LTD.) and carboxylic acid-modified polyolefin resin (product name "H511" manufactured by Mitsubishi Chemical Corporation) were used for the oxygen-absorbing layer, the gas barrier layer and the adhesive resin layer, respectively, which constitute the intermediate layer. HDPE having a density of 0.948 (product name "B5203" manufactured by KEIYO POLYETHYLENE CO., LTD.) was used for the outermost layer (31).

The hollow container 1 was prepared so as to have an upper end surface 21 having a width of 2 mm and the hollow container 1 had a dimension in which the height was 83.5 mm, the outer diameter of a bottom of the container was 48 mm, and the inner diameter of a mouth part was 25.2 mm. The surface area of the innermost layer was 0.013 m$^2$.

As to the thickness of each layer in a body part of the container, the thickness of the innermost layer (30) was 150 μm, the thickness of the oxygen-absorbing layer was 300 μm, the thickness of the adhesive layer was 50 μm, the thickness of the gas barrier layer was 50 μm, the thickness of the adhesive resin layer was 50 μm in the intermediate layer (32), and the thickness of the outermost layer (31) was 800 μm.

Using the above-mentioned production process, the upper end flat part A of the opening part was formed, in which 1.9 mm out of 2 mm of the upper end surface 21 was covered by the LLDPE of the innermost layer 30 and the thickness of the innermost layer 30 on the upper end surface 21 was slightly thinner than thickness of the innermost layer 30 on the body part, with the thickness of the innermost layer (30) on the upper end surface 21 being 100 μm.

A cover 1 having the configuration of alumina vapor-deposited PET film (being the sealing member) 12 μm/Ny 15 μm/LL 50 μm was prepared.

(Evaluation of Oxygen-Absorbing Performance and Inspection of Tamper Evidence Function)

The number of days required for deoxidation of the hollow container 1 (i.e., the number of days required until the oxygen concentration inside the container became 0.1 vol % or less) was measured by the following procedure.

First, glass beads were introduced into the hollow container 1 so that the filling factor in the hollow container 1 became about 50 vol % of the total volume, a desiccant was added thereto so that the humidity inside the container became 5% RH or less, and an oxygen concentration sensor was also introduced into the hollow container 1 and the hollow container 1 was then sealed. The amount of air (head space) inside the hollow container was adjusted so as to be 60 mL.

The hollow container 1 and the cover 1 were sealed using a package sealer (EPK manufactured by ESHIN PACK IND. CO., LTD.)

Using a sealing board having a shape capable of providing sealing in a ring shape having a width of 1 mm, a sealing having a width of 1 mm was provided at the center of the upper end flat part A having a width of 2 mm in the container. As a result, a black oxygen-absorbing layer having the metallic powder 1 incorporated therein could be observed through the cover 1 and it could be confirmed that the sealing was provided in an appropriate manner.

The container after sealing was stored at 25° C. and the oxygen concentration per elapsed day was measured by an optical oxygen meter (product name "Fibox 3") manufactured by TAITEC CORPORATION. As a result, the oxygen concentration reached 0.1 vol % after 14 days. The color of the sealing part was jet black and the exertion of the oxygen-absorbing performance could be confirmed.

When the sealing member was stripped off, part of the oxygen-absorbing layer of the container body was left on the cover 1, which was easily detectable even after the container was resealed. Therefore, tamper evidence for suppressing tampering could be provided.

Example 2

(Preparation of Metallic Powder 2)

500 kg of reduced iron powder having an average particle size of 30 μm was introduced into a vacuum mixing dryer equipped with a heating jacket, then heated under a reduced pressure of −720 mmHg at 110° C. while being subjected to spraying of 5 kg of a 50 wt % aqueous solution of calcium chloride, then dried for 2 hours and sieved to remove coarse particles of 50 μm or larger to thereby obtain the metallic powder 2.

(Preparation of Oxygen-Absorbing Resin Pellet 2)

Metallic powder 2 and LLDPE were melted and kneaded at a ratio of the metallic powder 2:LLDPE=30:70 (mass ratio), extruded into a strand shape using a twin screw extruder having two types of feeders—a main feeder and a side feeder—and cut by a pelletizer to thereby obtain an oxygen-absorbing resin pellet 2. The LLDPE was introduced into the main feeder and the metallic powder 2 was added to the melted LLDPE through the side feeder. The density of the oxygen-absorbing resin pellet 2 was 1.3 g/cm$^3$.

(Preparation of Oxygen-Absorbing Hollow Container 2)

An oxygen-absorbing hollow container 2 was prepared in the same way as in Example 1, except that the oxygen-absorbing resin pellet 2 was used instead of the oxygen-absorbing resin pellet 1.

The hollow container 2 was prepared so as to have an upper end surface 21 having a width of 2 mm and the hollow container 2 had a dimension in which the height was 83.5 mm, the outer diameter of a bottom of the container was 48 mm, and the inner diameter of a mouth part was 25.2 mm. The surface area of the innermost layer was 0.013 m$^2$.

As to the thickness of each layer in a body part of the container, the thickness of the innermost layer (30) was 150 μm, the thickness of the oxygen-absorbing layer was 300 μm, the thickness of the adhesive layer was 50 μm, the thickness of the gas barrier layer was 50 μm, and the thickness of the adhesive resin layer was 50 μm in the intermediate layer (32), and the thickness of the outermost layer (31) was 800 μm.

Using the above-mentioned production process, the upper end flat part A of the opening part was formed, in which 1.9 mm out of 2 mm of the upper end surface 21 was covered by the LLDPE of the innermost layer 30 and the thickness of innermost layer 30 on the upper end surface 21 was slightly thinner than the thickness of innermost layer 30 on the body part, with the thickness of the innermost layer (30) being 100 μm.

(Evaluation of Oxygen-Absorbing Performance and Inspection of Tamper Evidence Function)

The number of days required for deoxidation of the hollow container 2 (i.e., the number of days required until the oxygen concentration inside the container became 0.1 vol % or less) was measured by the following procedure.

First, glass beads were introduced into the hollow container 2 so that the filling factor of the hollow container 2 became about 50 vol % of the total volume, a humidity conditioning agent which causes the humidity inside the container to be 50% RH or less was added thereto, and an oxygen concentration sensor was also introduced into the hollow container 2 and the hollow container 2 was then sealed. The amount of air (head space) inside the hollow container was adjusted so as to be 60 mL.

The hollow container 2 and the cover 1 were sealed using a package sealer (EPK manufactured by ESHIN PACK IND. CO., LTD.)

Using a sealing board having a shape capable of providing sealing in a ring shape having a width of 1 mm, a sealing having a width of 1 mm was provided at the center of the upper end flat part A having a width of 2 mm in the container. As a result, a black oxygen-absorbing layer having the metallic powder 2 incorporated therein could be observed through the cover 1 and it could be confirmed that the sealing was provided in an appropriate manner.

The container after sealing was stored at 25° C. and the oxygen concentration per elapsed day was measured by an optical oxygen meter (product name "Fibox 3") manufactured by TAITEC CORPORATION. As a result, the oxygen concentration reached 0.1 vol % after 60 days. The color of the sealing part was reddish black and the exertion of the oxygen-absorbing performance could be confirmed.

When the sealing member was stripped off, part of the oxygen-absorbing layer of the container body was left on the cover 1, which was easily detectable even after the container was resealed. Therefore, a tamper evidence function for suppressing tampering could be provided.

INDUSTRIAL APPLICABILITY

The present invention is useful in providing a container having a function of leaving an unsealed mark.

REFERENCE SIGNS LIST

1: container
10: container body
11: sealing member
12: lid
20: opening part
21: upper end surface
30: innermost layer
31: outermost layer
32: intermediate layer
40: oxygen-absorbing layer
50: sealing board
A: flat part

What is claimed is:

1. A container, comprising:

a container body having a multilayer structure constituted by an innermost layer, an outermost layer and at least one intermediate layer therebetween, the container body having an opening part on an upper part thereof; and a sealing member bonded to an upper end surface of the opening part of the container body to seal an opening of the opening part, wherein:

the innermost layer and at least a layer, which is adjacent to the innermost layer, in the intermediate layer are bent outward at an upper end of the opening part and form a flat part, and a surface of the flat part forms the upper end surface of the opening part;

the outermost layer is not bent outward;

distal end surfaces of the innermost layer and the intermediate layer in the flat part are covered by the outermost layer; and when the sealing member is unsealed, part of the innermost layer on the upper end surface of the opening part is configured to be peeled off so as to leave an unsealed mark.

2. The container according to claim 1, wherein the intermediate layer has an oxygen-absorbing layer and/or a water-absorbing layer.

3. The container according to claim 1, wherein the innermost layer at the flat part has a thickness of 200 μm or less.

4. The container according to claim 1, wherein the sealing member is bonded in an annular shape to the surface of the flat part that constitutes the upper end surface of the opening part.

5. The container according to claim 1, wherein the innermost layer has a smaller thickness than the outermost layer.

6. The container according to claim 1, wherein the innermost layer is made of a material having a lower strength than the outermost layer.

7. The container according to claim 1, wherein the innermost layer contains low density polyethylene and/or linear short-chain branched polyethylene.

8. The container according to claim 1, wherein the flat part has a width that is 50% or more of a width of the upper end surface of the opening part.

9. The container according to claim 1, wherein at least one layer of the intermediate layer in the flat part is colored.

10. The container according to claim 9, wherein the innermost layer is colored and has a color different from the colored layer in the intermediate layer.

11. The container according to claim 9, wherein a plurality of layers including a surface layer in the intermediate layer is colored.

12. The container according to claim 1, wherein the sealing member is transparent.

* * * * *